US010520268B1

(12) United States Patent
Viani

(10) Patent No.: US 10,520,268 B1
(45) **Date of Patent: *Dec. 31, 2019**

(54) ERGONOMIC MAGAZINE SELF CLEANING BASE PLATE

(71) Applicant: Arthur J. Viani, Miami, FL (US)

(72) Inventor: Arthur J. Viani, Miami, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/415,234

(22) Filed: May 17, 2019

Related U.S. Application Data

(63) Continuation-in-part of application No. 15/685,518, filed on Aug. 24, 2017.

(51) Int. Cl.
*F41A 9/61* (2006.01)
*F41A 9/65* (2006.01)
*F41A 11/00* (2006.01)

(52) U.S. Cl.
CPC ..... *F41A 9/65* (2013.01); *F41A 11/00* (2013.01)

(58) Field of Classification Search
CPC ..... F41A 9/65
USPC ..... 42/50
See application file for complete search history.

(56) References Cited

U.S. PATENT DOCUMENTS

2005/0011097 A1 1/2005 Freed et al.
2008/0190003 A1 8/2008 Bolen
2013/0333261 A1 12/2013 Clifton, Jr. et al.
2014/0047751 A1 2/2014 Lee

*Primary Examiner* — J. Woodrow Eldred
(74) *Attorney, Agent, or Firm* — Albert Bordas, P.A.

(57) ABSTRACT

An ergonomic magazine self cleaning base plate having an exterior face with a perimeter edge. Extending from the perimeter edge is a forward face and an aft section. Further having an interior face with at least one channel that extends from the forward face to the aft section. Debris accumulated within the at least one channel and exits via the aft section and/or the forward face.

22 Claims, 11 Drawing Sheets

PRIOR ART

PRIOR ART

PRIOR ART

ERGONOMIC MAGAZINE SELF CLEANING BASE PLATE

OTHER RELATED APPLICATIONS

The present application is a continuation-in-part of pending U.S. patent application Ser. No. 15/685,518, filed on Aug. 24, 2017, which is hereby incorporated by reference.

BACKGROUND OF THE INVENTION

Field of the Invention

The present invention relates to magazines for firearms, and more particularly, to ergonomic self-cleaning base plates.

Description of the Related Art

Applicant believes that one of the closest references corresponds to U.S. Patent Application Publication No. 2013/0333261 A1, published on Dec. 19, 2013 to Clifton, J R., et al. for Magazine base pad. However, it differs from the present invention because Clifton, J R., et al. teach a magazine that has a body member having a front, a back, and opposing side walls that define a first orifice at a first distal end of the body member, a retention plate member having a base, end wall, and retention spring portion. A planar engagement surface extends from the base portion at an oblique angle relative to the base portion, wherein a portion of the front wall of the body member is disposed in a gap defined by the end wall portion and the retention spring portion. An end plate member slidably engaging the body member, the end plate member has a base portion that defines an orifice having an engagement surface defining an oblique angle relative to the base portion, wherein the planar engagement surface of the retention plate member is disposed in the orifice in contact with the planar engagement surface of the end plate member.

Applicant believes that another reference corresponds to U.S. Patent Application Publication No. 2014/0047751 A1, published on Feb. 20, 2014 to Randall M. Lee for Ammunition magazine base pad retaining plate. However, it differs from the present invention because Lee teaches an ammunition magazine base pad retaining plate with a protrusion including a shaft portion, a flange portion having a lager cross sectional diameter than the shaft portion, and a longitudinal slot to allow lateral compression. When attached to a magazine base pad in a magazine assembly, the configuration of the base pad retaining plate eliminates the possibility that the base pad retaining plate will disengage from the base pad resulting in catastrophic disassembly of the ammunition magazine.

Applicant believes that another reference corresponds to U.S. Patent Application Publication No. 2005/0011097 A1, published on Jan. 20, 2005 to Freed, et al. for Two-piece snap-on handgun magazine adapter. However, it differs from the present invention because Freed, et al. teach a two-piece snap-on magazine adapter for a handgun. This magazine adapter provides a relatively continuous surface between the handgun and locked extended length magazine to afford the handgun user with a grip. The magazine adapter has two snap together pieces: a main body and an end cap. The main body has an interior pocket configuration contoured to capture the magazine floor plate. The main body of the device is then captured by an end cap that locks via a detent mechanism onto the main adapter body. The magazine adapter fits completely around the magazine such that when the magazine is locked into the handgun, the resulting grip provides a fit between the extended length magazine's floor plate and the butt of the handgun's grip. The magazine adapter may be adapted to fit handgun models desirous of using extended length magazines without modification of the magazine itself.

Applicant believes that another reference corresponds to U.S. Patent Application Publication No. 2008/0190003 A1, published on Aug. 14, 2008 to John Bolen for Base pad for firearm magazine. However, it differs from the present invention because Bolen teaches a base pad for a firearm magazine that attaches to the bottom of a magazine tube in a manner, to attach or remove therefrom when cleaning the magazine. The base pad has a body member with a pair of ends and a pair of sides. The sides each have a groove configured to slidably receive, preferably snugly, the lips at the bottom of a standard magazine tube. One end of the base pad has an outwardly extending section with an upwardly facing, generally planar face. A securing mechanism at the outwardly extending section has an upwardly disposed projection that selectively engages one wall of the magazine tube to secure the base pad thereto when in its engaged position and allows removal of the base pad when in a disengaged position.

Other patents describing the closest subject matter provide for a number of more or less complicated features that fail to solve the problem in an efficient and economical way. None of these patents suggest the novel features of the present invention.

SUMMARY OF THE INVENTION

The present invention is an ergonomic magazine self cleaning base plate comprising an exterior face having a perimeter edge. Extending from the perimeter edge is a forward face and an aft section. Further comprising an interior face having at least one channel that extends from the forward face to the aft section. Debris accumulated within the at least one channel and exits via the aft section and/or the forward face.

The forward face is open, being defined by the at least one channel and first and second side faces, and the exterior face comprises a hole that extends to the interior face. The exterior face comprises at least one indent and is convexly shaped. The forward face is positioned opposite of the aft section. The at least one channel is open at each of its ends. The first and second side faces comprise first and second grip sections. The first and second side faces comprise first and second sidewalls respectively. The first and second sidewalls extend a predetermined distance without reaching the aft section. The first and second grip sections extend from the perimeter edge, and are relatively concavely shaped. The first and second sidewalls extend from the respective first and second grip sections at the interior face. The first and second sidewalls are parallel to each other. The first and second sidewalls each comprise an edge. Each edge defines a respective lip. Each lip extends a predetermined distance from a respective edge. The lip defines a side channel that receives a base edge of a magazine tube.

When the side channels receive the base edge of the magazine tube, the base edge is exposed at a magazine forward face section. Furthermore, when the side channels receive the base edge of the magazine tube, the at least one channel and the base edge define at least one opening at the forward face and at the aft section respectively, whereby the forward face and the aft section remain open and connected by the first and second channels.

Present invention further comprises an ergonomic magazine self cleaning base plate comprising an exterior face having a perimeter edge, extending from the perimeter edge is a forward face and an aft section, and further comprising an interior wall, and an interior face defining at least one channel that extends from the forward face to the aft section. The at least one channel is open at each of its ends, and is L-shaped. Debris is accumulated within the at least one channel and exits via the aft section and/or the forward face.

The interior wall extends from the aft section toward the forward face defining first and second slots with respective lateral interior faces. The forward face is positioned opposite of the aft section. The forward face is defined by the at least one channel, first and second side faces, and the interior wall. The aft section extends from the perimeter edge to an edge. The exterior face comprises at least one indent and a hole that extends to the interior wall. The exterior face is convexly shaped.

The first and second side faces comprise first and second grip sections and first and second sidewalls respectively. The first and second grip sections extend from the perimeter edge and are relatively concavely shaped. The first and second sidewalls extend, parallel to each other, from respective first and second grip sections.

First and second lips extends from respective lateral interior faces defining predetermined openings with the interior wall, whereby the openings and the first and second slots receive respective tabs of a magazine tube.

When the openings and the first and second slots receive the tabs of the magazine tube, the debris falls through the first and second slots and is accumulated within the at least one channel and exits via the aft section and/or the forward face.

A magazine insert is positioned onto the interior wall. The magazine insert comprises inner sides that allow that debris is accumulated onto an exposed section of the interior wall to falls through the first and second slots.

It is therefore one of the main objects of the present invention to provide an ergonomic magazine self cleaning base plate.

It is another object of this invention to provide an ergonomic magazine self cleaning base plate comprising at least one channel.

It is another object of this invention to provide an ergonomic magazine self cleaning base plate in which debris accumulated in the at least one channel may exit therefrom.

It is another object of this invention to provide an ergonomic magazine self cleaning base plate in which debris accumulated in the at least one channel exits therefrom via an aft section.

It is another object of this invention to provide an ergonomic magazine self cleaning base plate in which debris accumulated in the at least one channel exits therefrom via a forward face.

It is another object of this invention to provide an ergonomic magazine self cleaning base plate, which is of a durable and reliable construction.

It is yet another object of this invention to provide an ergonomic magazine self cleaning base plate that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
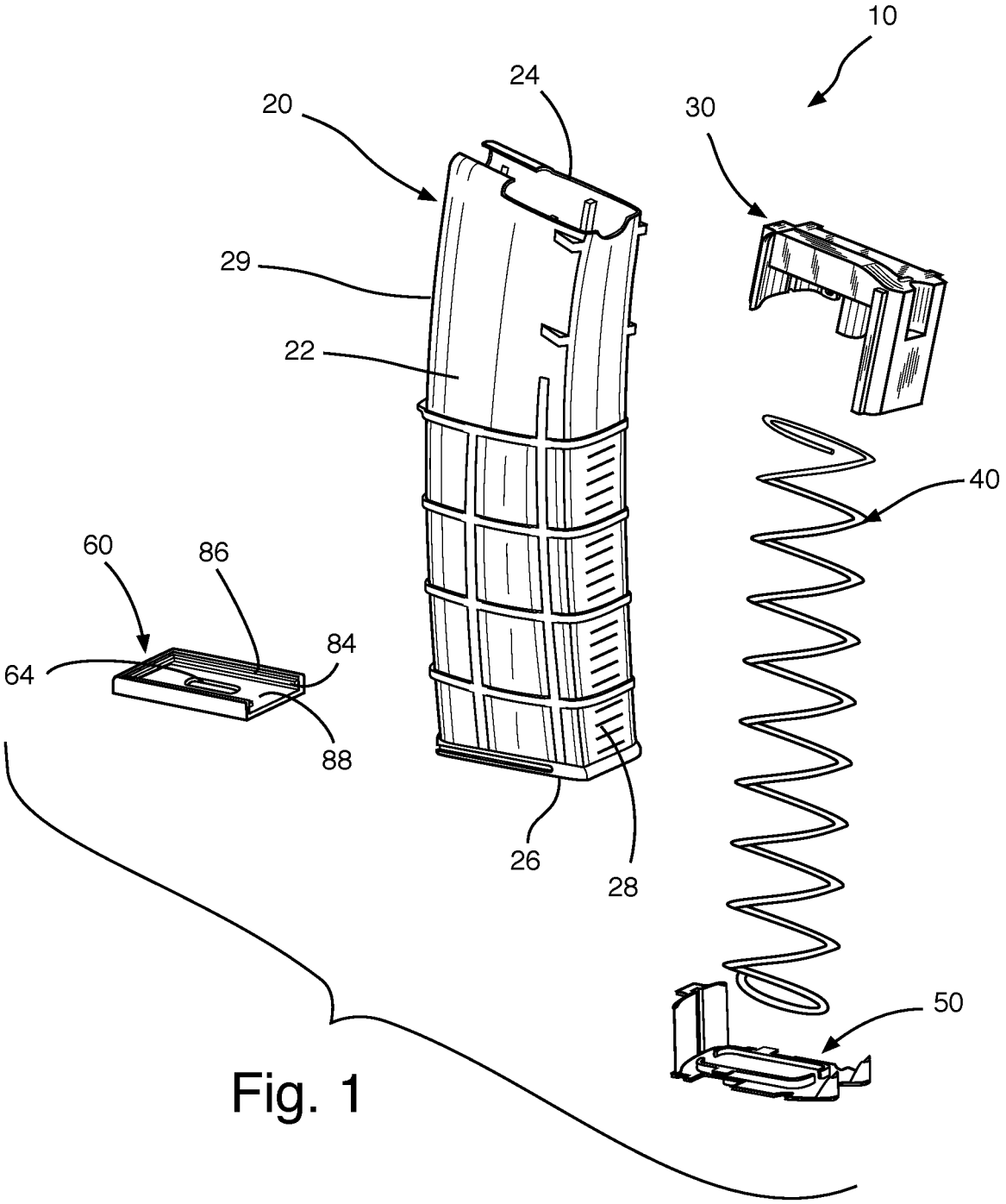
FIG. 1 represents a first prior art magazine assembly.

Referring now to the drawings, the present invention is an ergonomic magazine self cleaning base plate that is also defined as a magazine floor plate, and is generally referred to with numerals 160 and 260.

As seen in FIG. 1, prior art magazine assembly 10 comprises magazine tube 20 having sidewall 22, top edge 24, and base edge 26. Magazine tube 20 further has magazine forward face 28 and magazine aft face 29. Prior art magazine assembly 10 further comprises follower 30, magazine spring 40, magazine insert 50, and magazine floor plate 60. Magazine floor plate 60 comprises hole 64, side channel 84 that is defined by lip 86, and interior face 88.

It is noted that the AR-15 was first built in 1959 by ArmaLite as a small arms rifle. Both the original design as well as many variants are now generally referred to as an "AR" type rifle. Modern weapons such as the AR type rifles are cleaned periodically to maintain the operating condition of the weapon.

Figure 2:
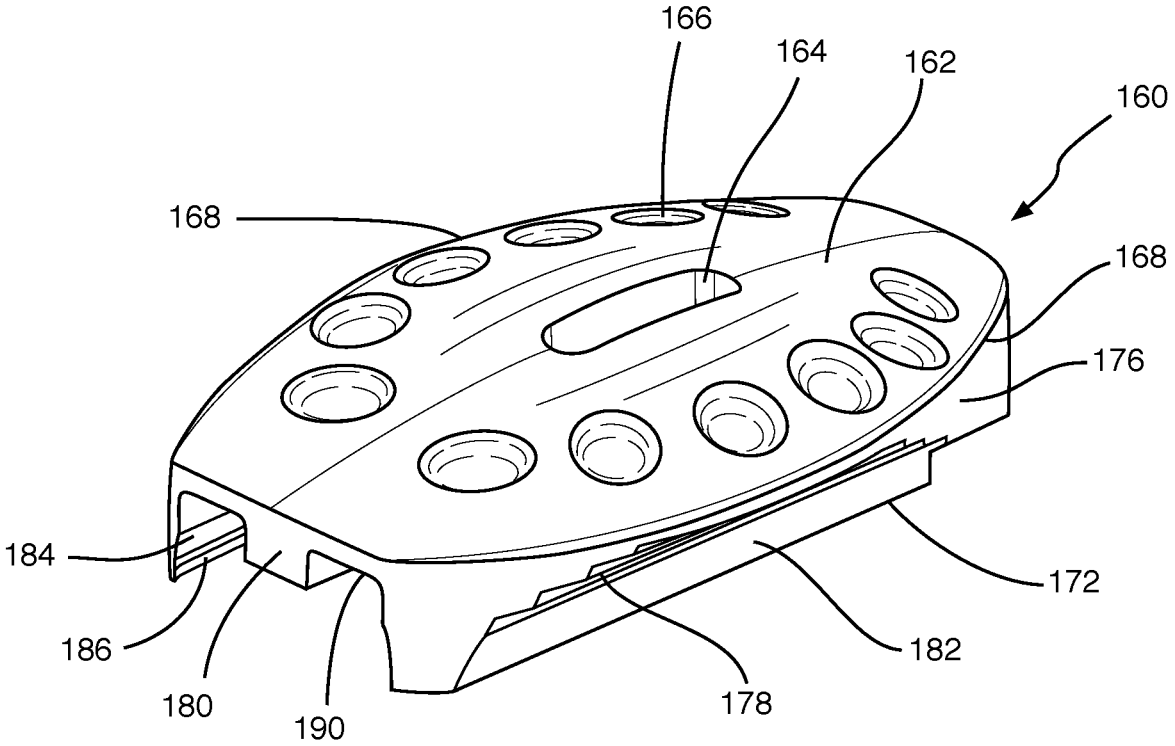
FIG. 2 is a first isometric view of a magazine floor plate.
Figure 3:
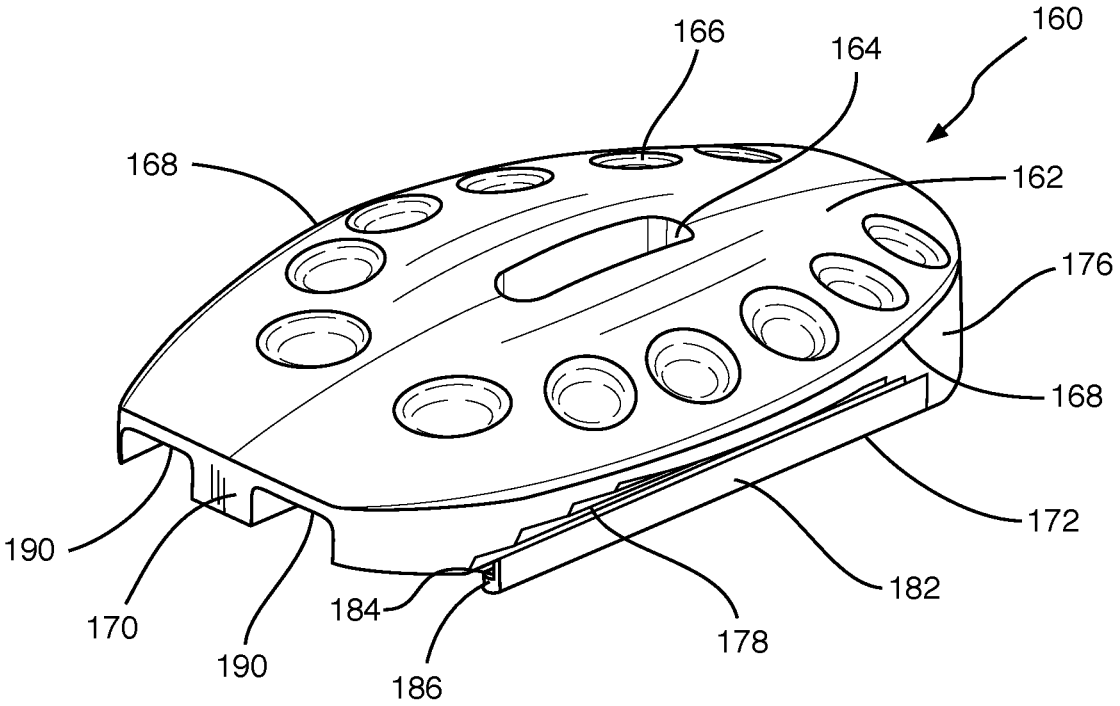
FIG. 3 is a second isometric view of the magazine floor plate.

As seen in FIGS. 2 and 3, magazine floor plate 160 comprises exterior face 162 having perimeter edge 168.

Extending from perimeter edge 168 is forward face 170 and aft section 180. Exterior face 162 is convexly shaped and comprises at least one indent 166.

Forward face 170 is opened, and defined by at least one channel 190 and first and second sidewalls 182. Forward face 170 is positioned opposite to aft section 180. First and second side faces 176 extend from perimeter edge 168. First and second side faces 176 comprise first and second grip sections 178, and first and second sidewalls 182 respectively. First and second grip sections 178 extend from perimeter edge 168, and first and second sidewalls 182 extend from respective grip sections 178 at interior face 188, seen in FIG. 4.

Respective first and second sidewalls 182 are parallel to each other and extend a predetermined distance from forward face 170 without reaching aft section 180. First and second sidewalls 182 comprise respective edges 172 that define respective lips 186. Lips 186 extend a predetermined distance from respective edges 172 and define side channels 184 to receive base edge 26, as seen in FIG. 6.

Figure 4:
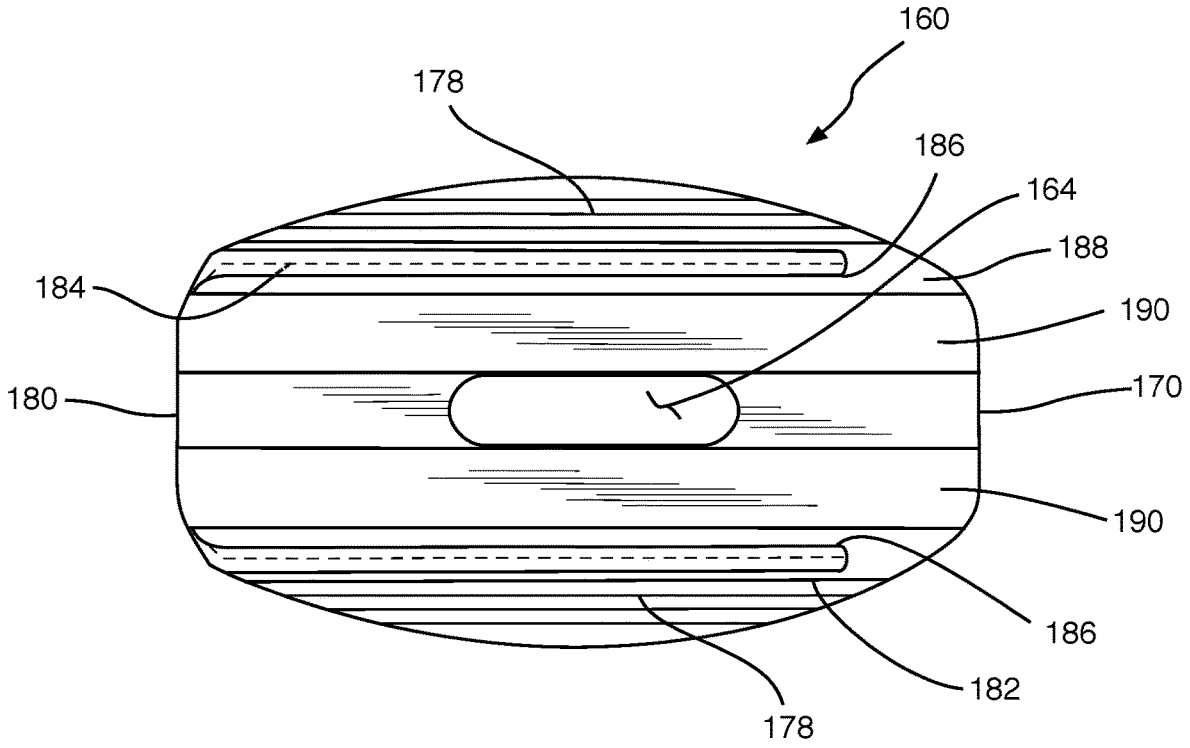
FIG. 4 is an elevational view of an interior face of the magazine floor plate.

As seen in FIG. 4, magazine floor plate 160 further comprises interior face 188. At least one channel 190 extends from forward face 170 to aft section 180 and is opened at both respective ends. At least one channel 190 is designed to minimize debris accumulation. In a preferred embodiment, there are first and second channels 190 opened at respective ends.

Figure 5:
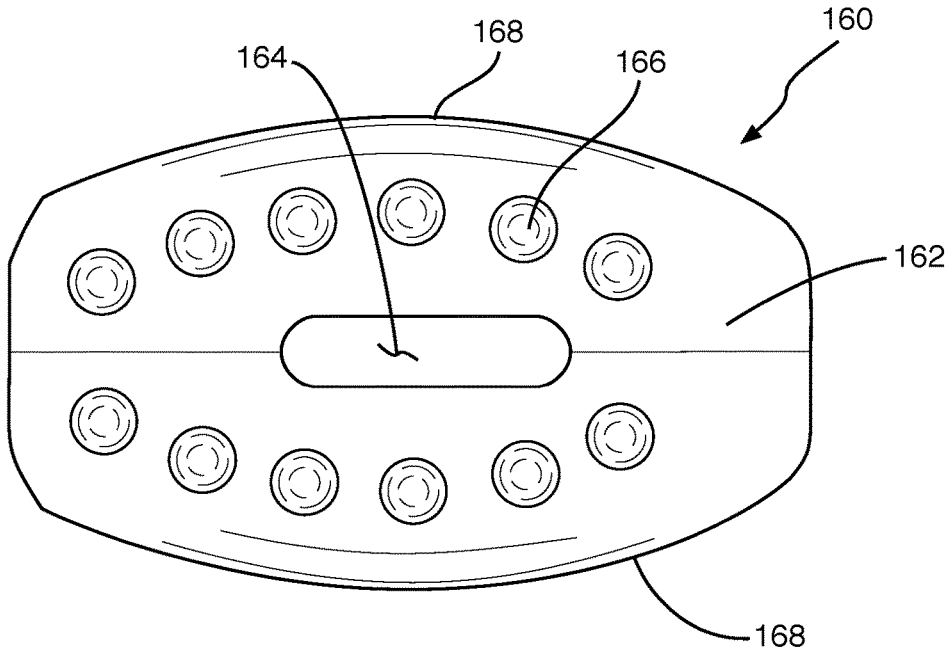
FIG. 5 is a top view of the magazine floor plate.

As seen in FIG. 5, exterior face 162 of magazine floor plate 160 comprises hole 164. Hole 164 extends from exterior face 162 to interior face 188, seen in FIG. 4. Hole 164 receives a protrusion protruding from magazine insert 50, not seen, when magazine floor plate 160 covers magazine insert 50, seen in FIG. 1, and the magazine assembly is assembled. Exterior face 162 further comprises at least one indent 166. In a preferred embodiment, exterior face 162 comprises several indents 166, allowing for better friction when magazine floor plate 160 is handled. In alternate embodiments, exterior face 162 may comprise a plurality of protrusions on its surface, or be hatched, or otherwise be textured or rough for better friction when magazine floor plate 160 is handled.

Figure 6:
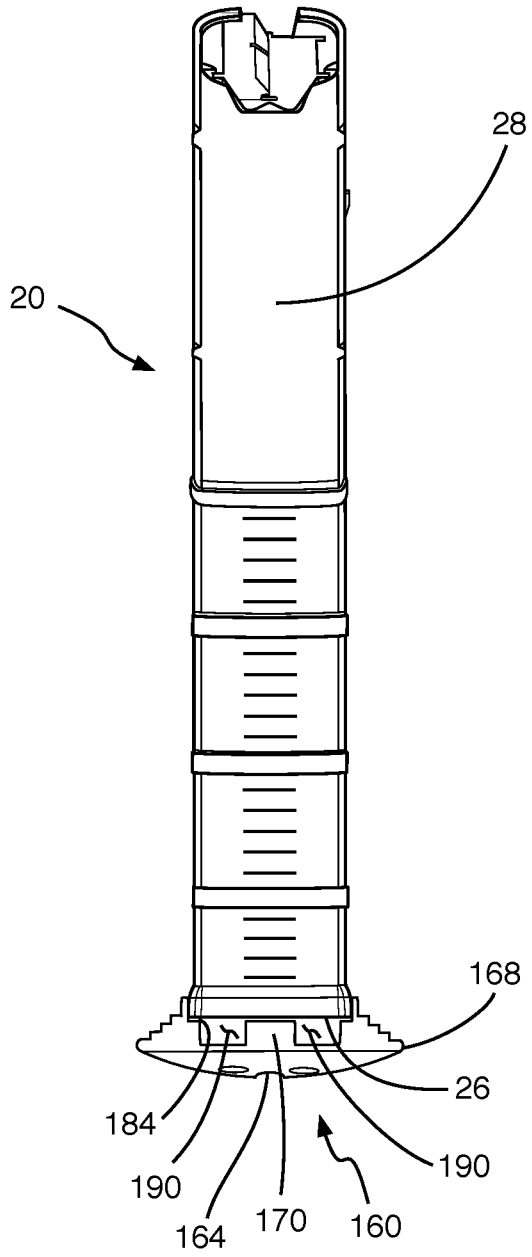
FIG. 6 is a rear isometric view of the magazine floor plate secured onto the first prior art magazine tube seen in FIG. 1.
Figure 7:
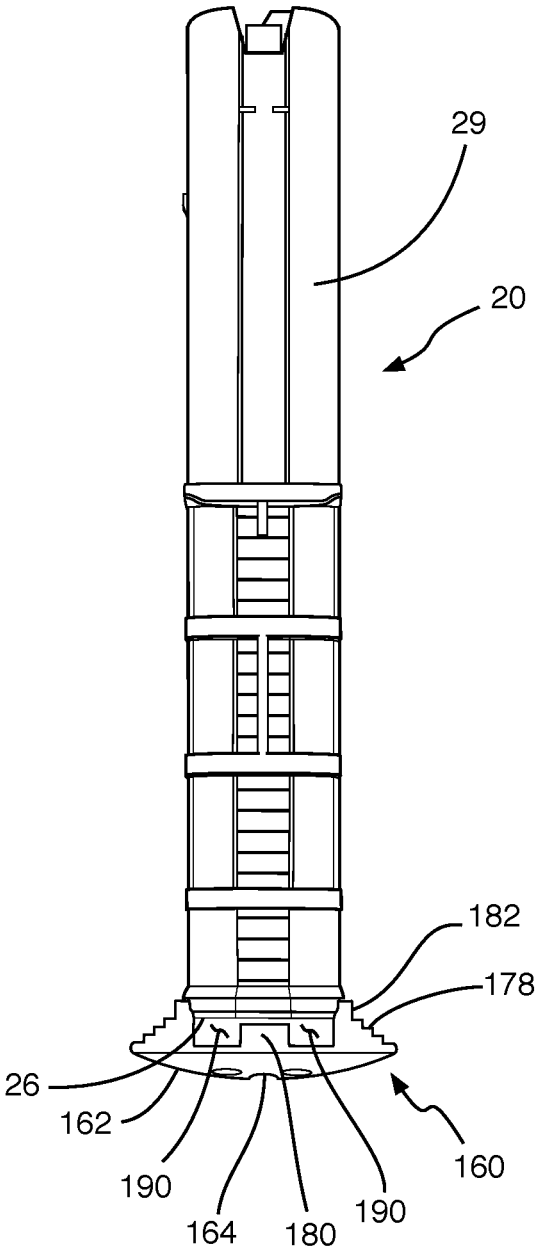
FIG. 7 is a front isometric view of the magazine floor plate secured onto the first prior art magazine tube seen in FIG. 1.

As seen in FIGS. 6 and 7, magazine floor plate 160 mounts onto magazine tube 20, wherein base edge 26 is exposed at a magazine forward face 28 section. First and second channels 190 and base edge 26 define two openings at forward face 170 and at aft section 180 respectively, whereby forward face 170 and aft section 180 remain open and connected by first and second channels 190.

While discharging a firearm, debris, not seen, is accumulated within first and second channels 190, whereby any debris that is produced and/or accumulates within magazine tube 20 falls by gravity and/or accumulates onto first and second channels 190. The debris may exit therefrom via the openings defined by first and second channels 190 that are formed at forward face 170, and/or at aft section 180. Therefore, magazine floor plate 160 promotes and/or functions as self-cleaning.

More specifically, debris comes from residue of the combustive effects and the cycling of discharging a semi-automatic/automatic cartridge utilizing the firearm; i.e. powder residue, brass particulate during the cycling of the firearm, also the environment in which the firearm and magazine tube 20 are used. Debris, as an example may be, but is not limited to, dirt, oils, sand, mud, powder, carbon, water, waterborne contaminants, and/or shavings, or combinations thereof.

Present invention 10 therefore causes the debris to be automatically shaken from the firearm, and more specifically magazine tube 20, by high-speed energy transmitted by the cycling of the action of the firearm. Additionally the debris can be readily and easily removed by a user, whereby the user may blow into first and second channels 190 with natural lung force or use a compressed air device or a method using a liquid. This ability to cleanse magazine tube 20 and first and second channels 190 of debris eliminates the need to disassemble magazine tube 20 for routine cleaning. Saving a significant amount of time.

Figure 8A:
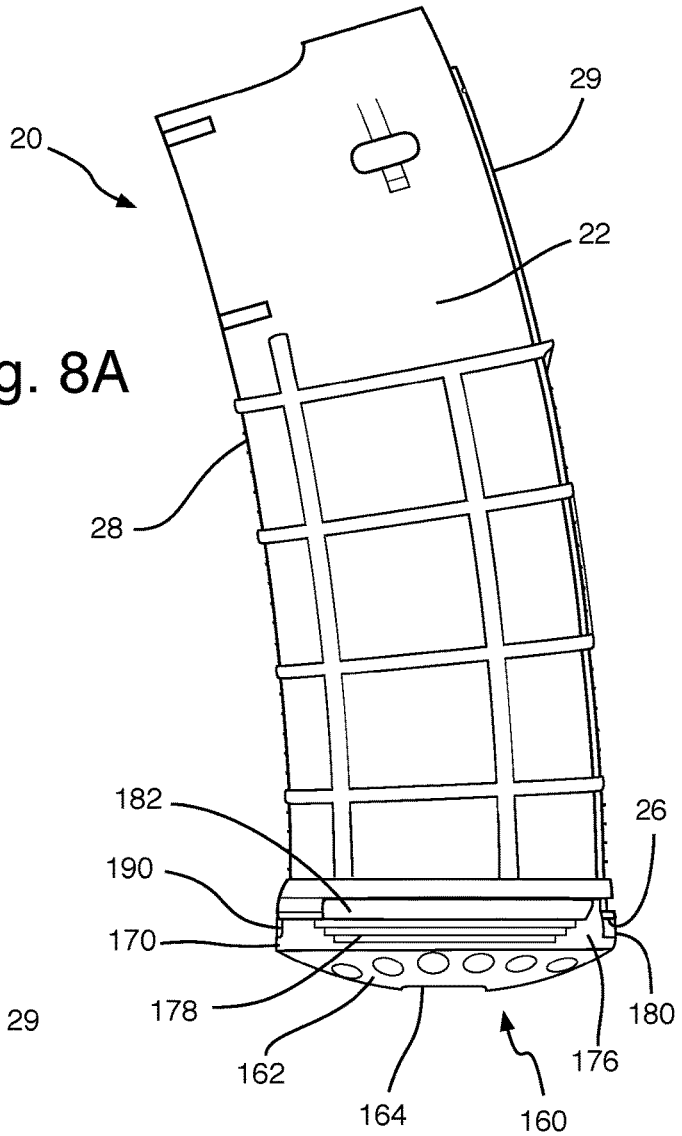
FIG. 8A is a left side view of the magazine floor plate secured onto the first prior art magazine tube seen in FIG. 1.
Figure 8B:
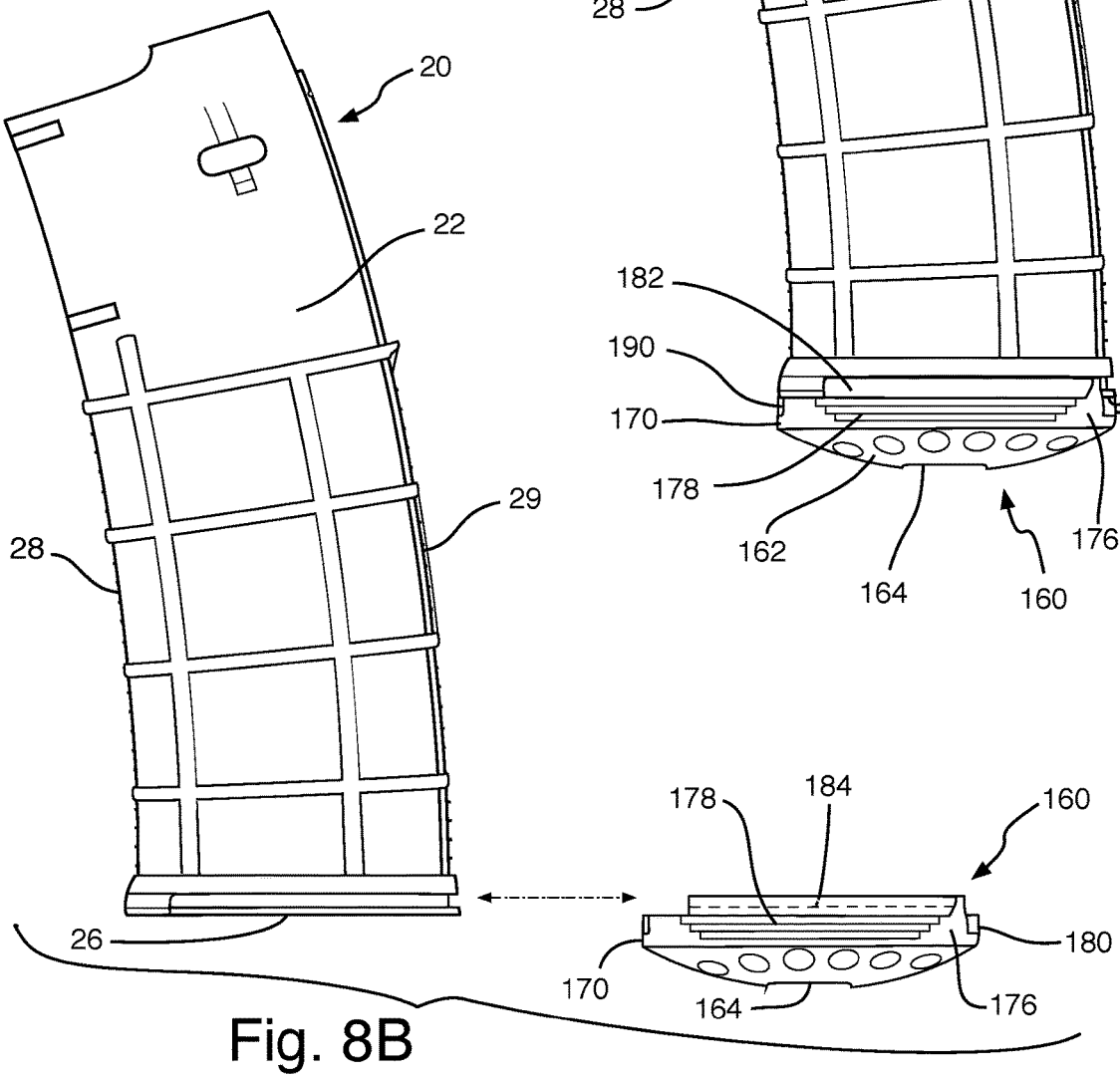
FIG. 8B is a left side view of the magazine floor plate being secured onto the first prior art magazine tube seen in FIG. 1.

As seen in FIG. 8A, magazine floor plate 160 is mounted onto magazine tube 20, whereby side channels 184, seen in FIG. 8B, receive base edge 26. Magazine forward face 28 corresponds with forward face 170, and magazine aft face 29 corresponds with aft face 180.

Sidewalls 22 of magazine tube 20 correspond with respective first and second side faces 176 of magazine floor plate 160. First and second side faces 176 each comprise grip section 178. Grip sections 178 are ergonomically shaped, and in a preferred embodiment, are concavely shaped to facilitate grasping and/or handling of magazine floor plate 160, especially when securing it onto, or removing it from, magazine tube 20.

Figure 9:
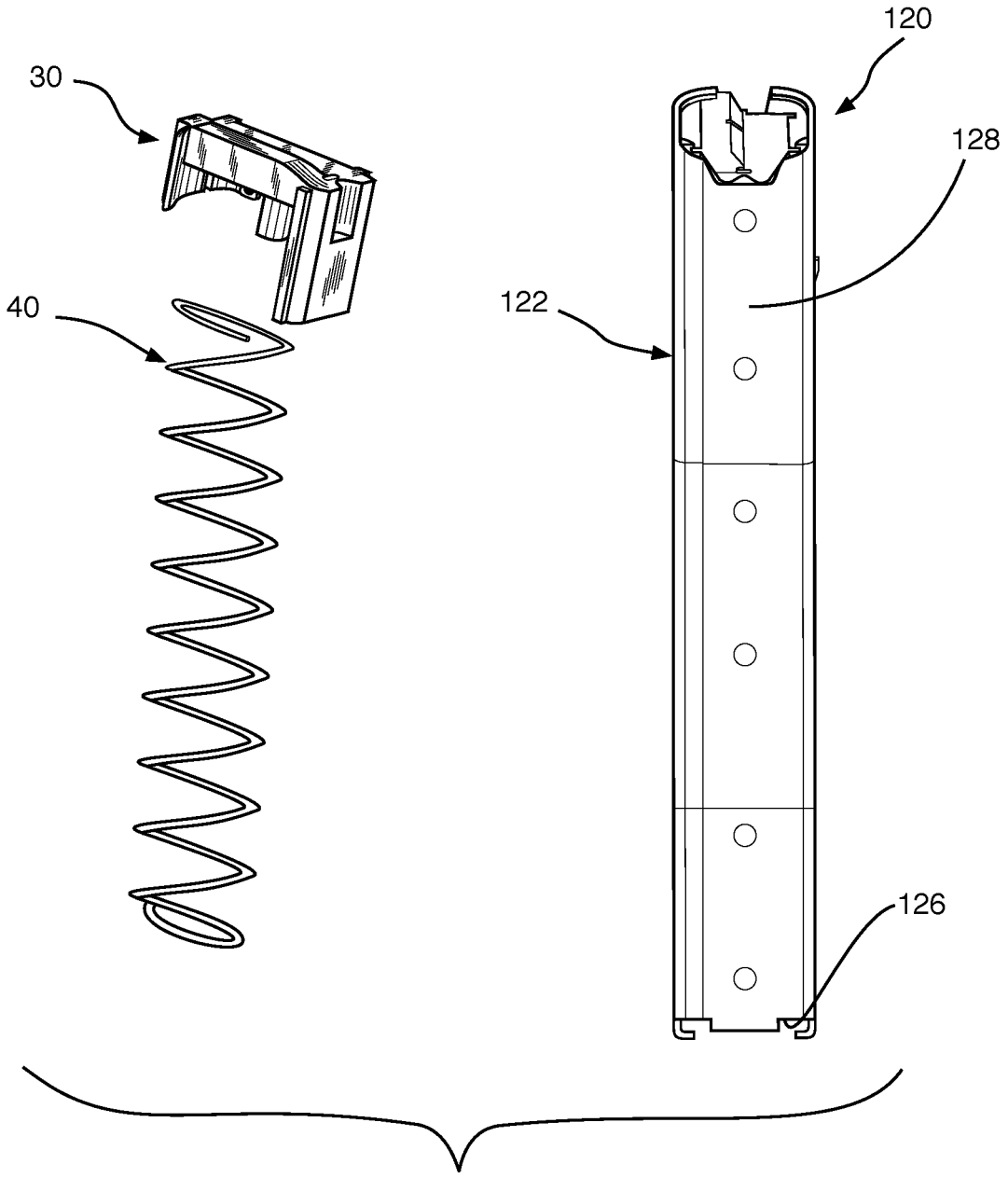
FIG. 9 represents a second prior art magazine assembly.
Figure 9A:
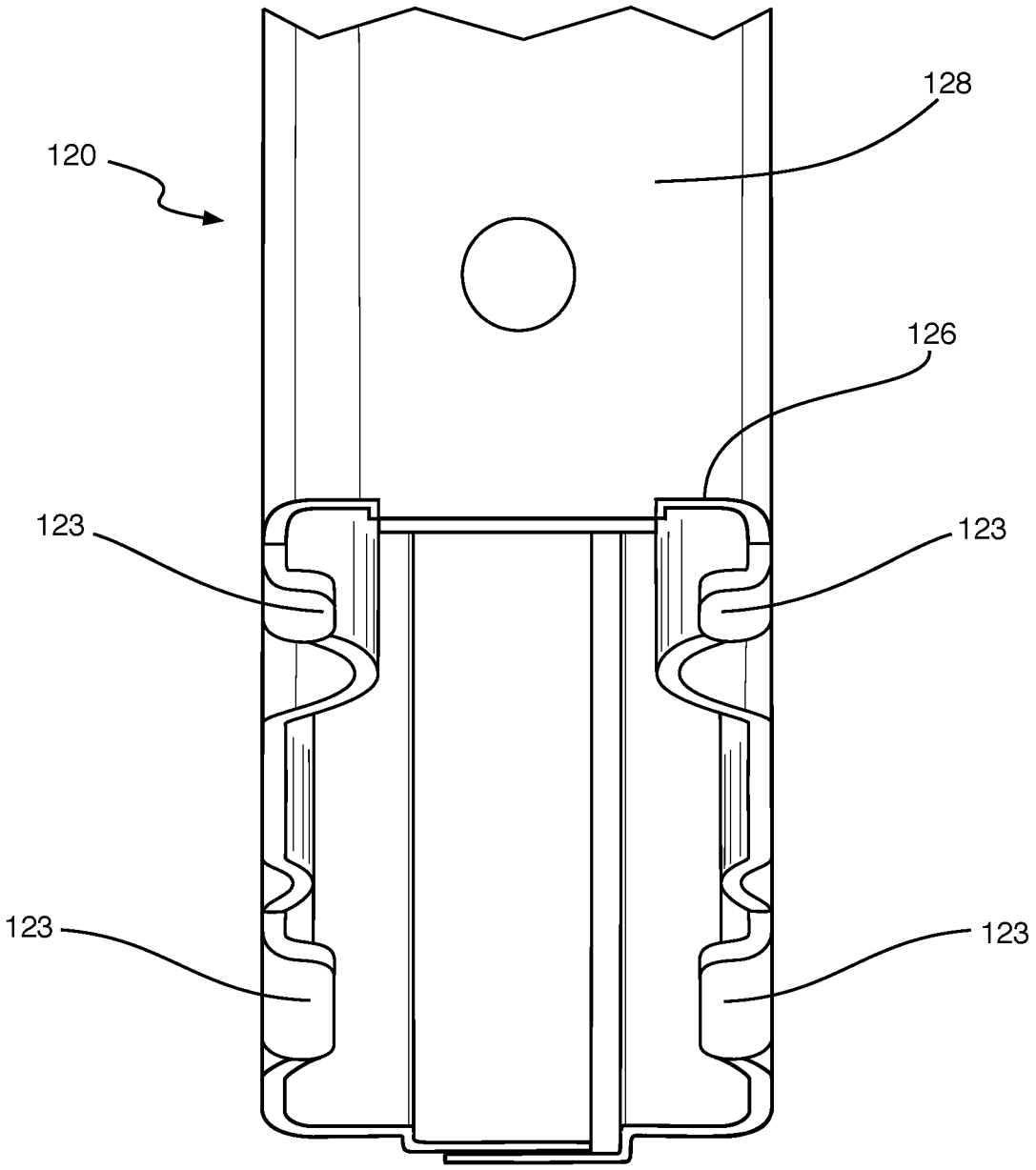
FIG. 9A represents a second prior art magazine tube.

As seen in FIGS. 9 and 9A, prior art magazine tube 120 comprises sidewall 122, base edge 126, and magazine aft face 128. Magazine tube 120 further comprises tabs 123 separated a predetermined distance from each other.

Figure 10:
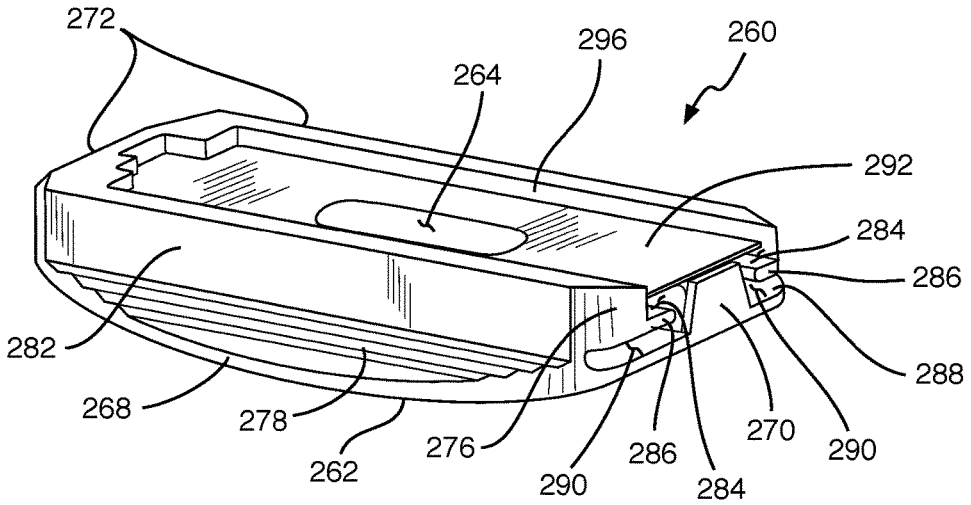
FIG. 10 is an isometric view of a magazine floor plate alternate embodiment.

As seen in FIG. 10, in another embodiment, magazine floor plate 260 comprises exterior face 262 having perimeter edge 268. Extending from perimeter edge 268 is forward face 270 and aft section 280, seen in FIG. 12. Magazine floor plate 260 further comprises interior face 288 and interior wall 292.

First and second lips 286 extend from respective lateral interior faces 296 defining predetermined openings 284 with interior wall 292.

Figure 11:
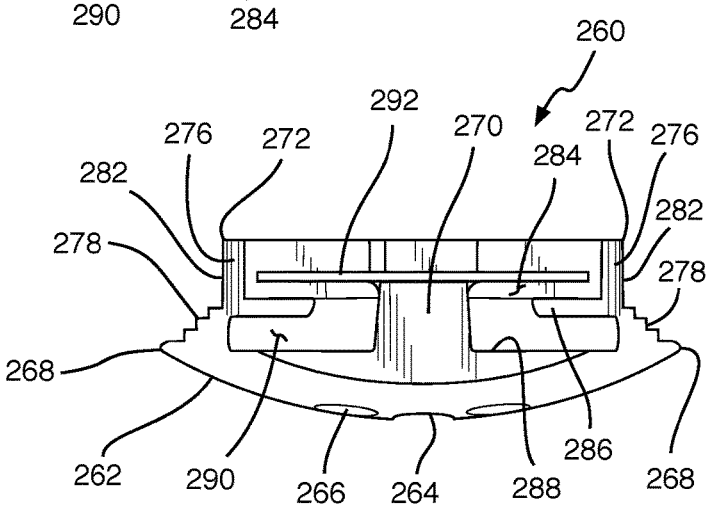
FIG. 11 is a front view of the magazine floor plate alternate embodiment.

As seen in FIG. 11, first and second side faces 276 comprise first and second grip sections 278, and first and second sidewalls 282 respectively. First and second grip sections 278 extend from perimeter edge 268 and are relatively concavely shaped. First and second sidewalls 282 extend, parallel to each other, from respective first and second grip sections 278.

Forward face 270 is defined by at least one channel 290, first and second side faces 276, and interior wall 292.

Figure 12:
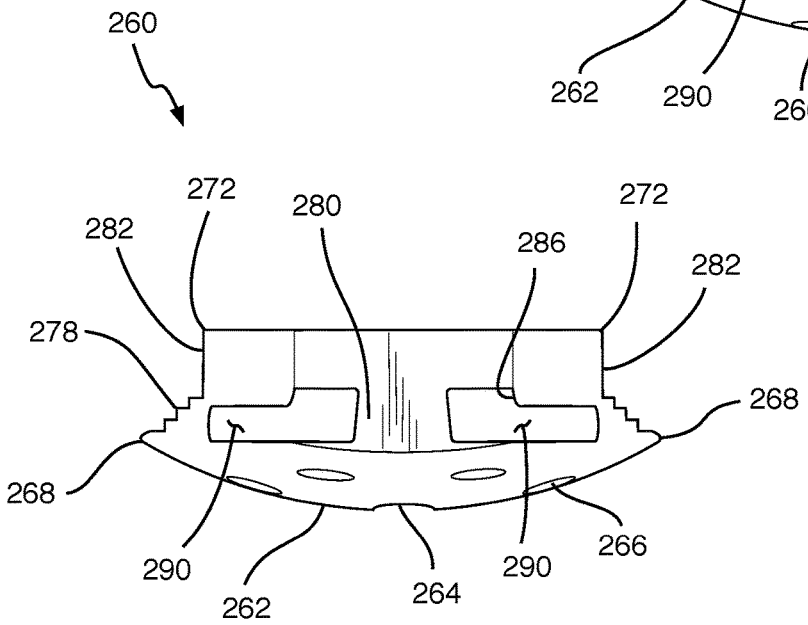
FIG. 12 is a rear view of the magazine floor plate alternate embodiment.

As seen in FIGS. 11 and 12, interior face 288 defines at least one channel 290 that extends from forward face 270 to aft section 280. At least one channel 290 is open at each of its ends. In a preferred embodiment, there are two channels 290, having an L-shape configuration.

As seen in FIG. 12, aft section 280 extends from perimeter edge 268 to edge 272.

Figure 13:
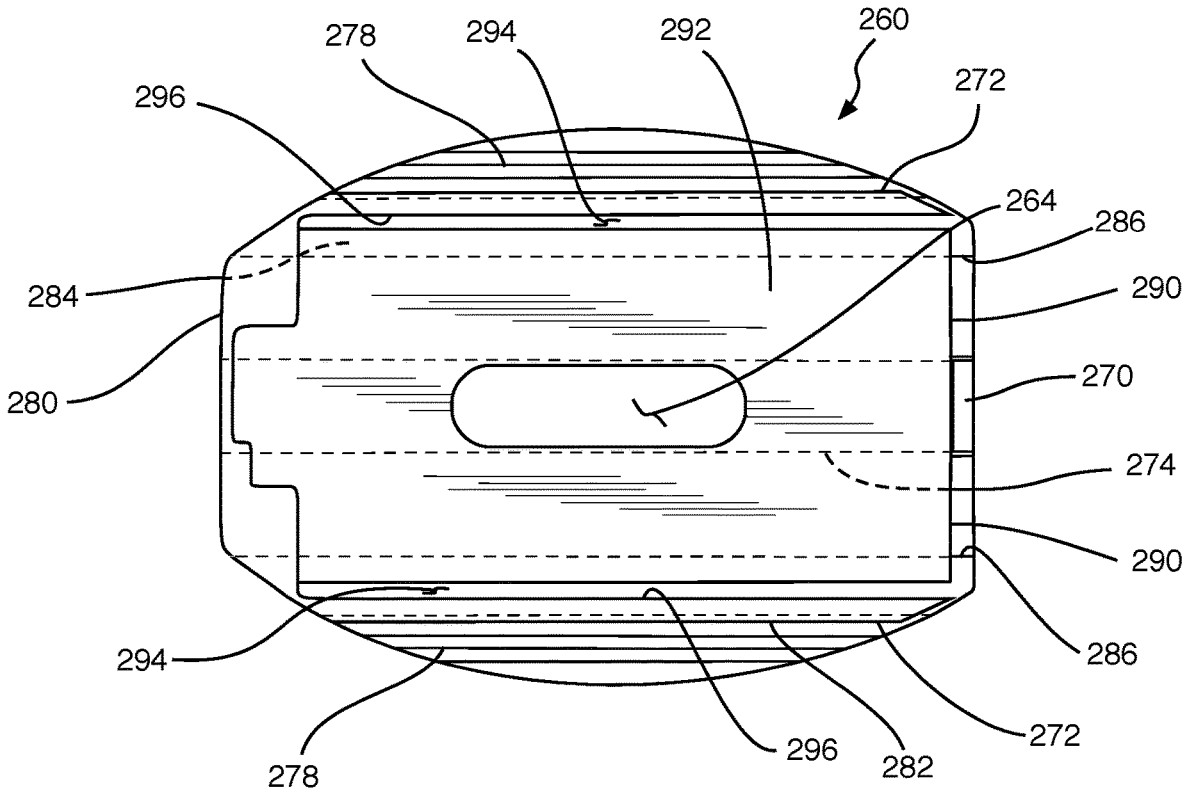
FIG. 13 is an elevational bottom view of the magazine floor plate alternate embodiment.

As seen in FIG. 13, interior wall 292, adjacent to aft section 280, extends towards forward face 270 defining first and second slots 294 with respective lateral interior faces 296. Openings 284 and first and second slots 294 receive respective tabs 123 of magazine tube 120, as seen in FIG. 9A. Interior wall 292 is attached to channel wall 274.

Figure 14:
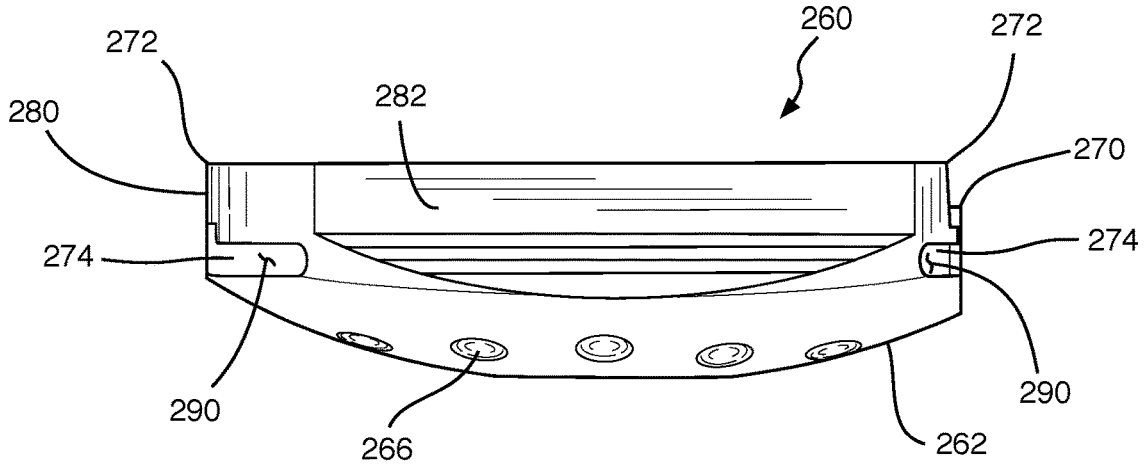
FIG. 14 is a side view of the magazine floor plate alternate embodiment.

As seen in FIG. 14, forward face 270 is positioned opposite of aft section 280. Exterior face 262 comprises hole 264, seen in FIG. 13, and at least one indent 266. Hole 264 extends from exterior face 262 to interior wall 292, as seen in FIG. 13. Exterior face 262 is convexly shaped.

Figure 15:
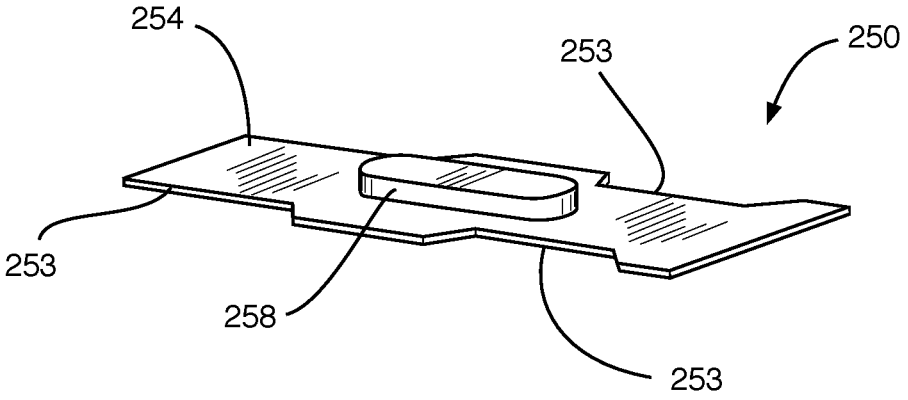
FIG. 15 is an isometric bottom view of a magazine insert alternate embodiment.
Figure 16:
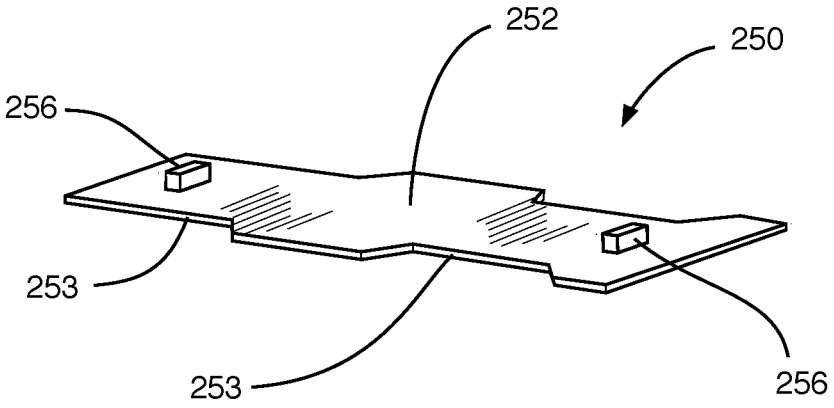
FIG. 16 is an isometric top view of the magazine insert alternate embodiment.

Seen in FIGS. 15 and 16 is an alternate embodiment magazine insert 250. Magazine insert 250 comprises internal face 252 and external face 254. Internal face 252 comprises tabs 256, and external face 254 comprises protrusion 258. Magazine insert 250 further comprises inner sides 253 that allows debris that falls by gravity and/or is accumulated onto an exposed section of interior wall 292, as seen in FIG. 10, to fall/pass through slots 294, seen in FIG. 13.

Figure 17:
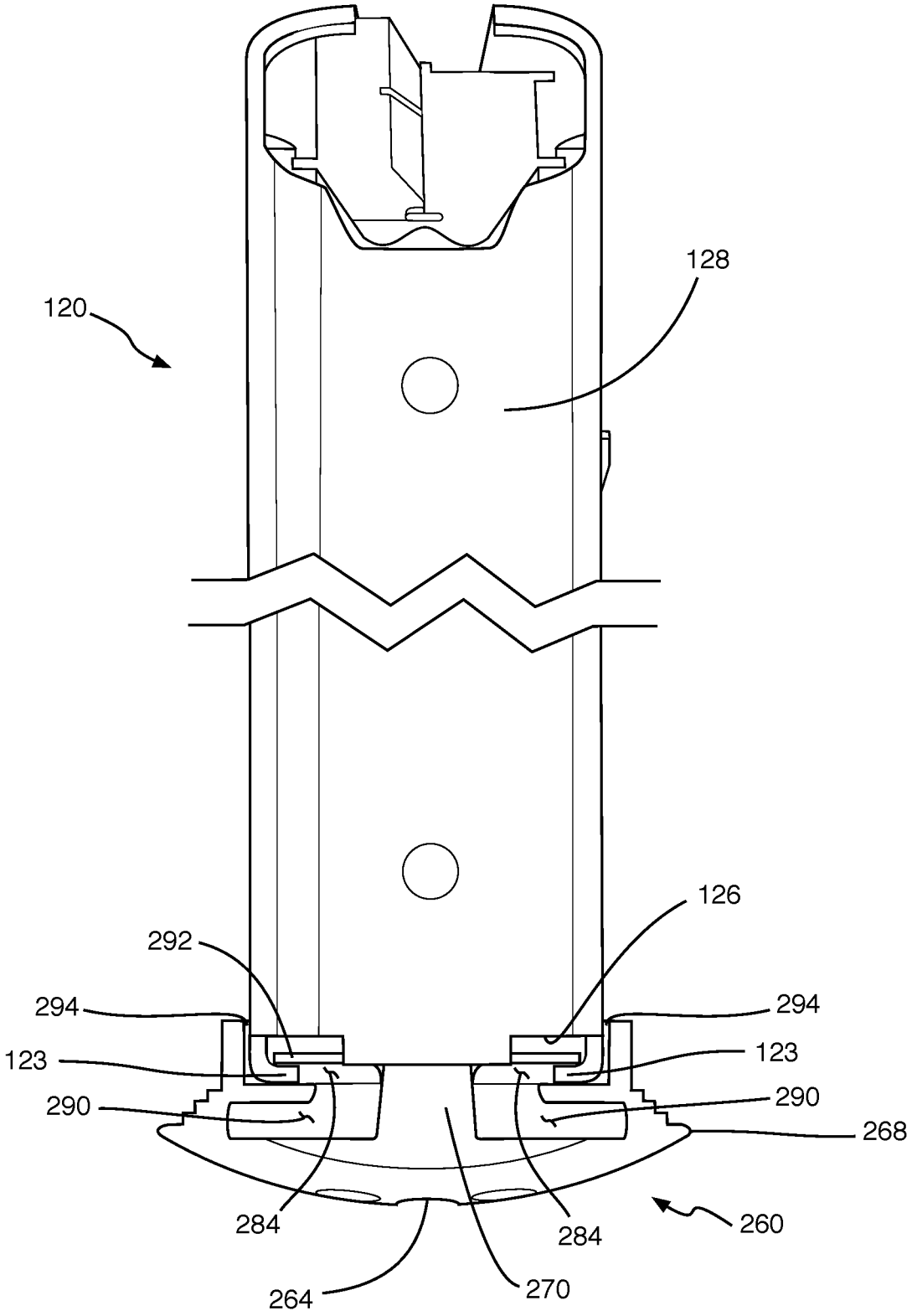
FIG. 17 is a front isometric view of the magazine floor plate alternate embodiment and magazine insert alternate embodiment secured onto the second prior art magazine tube seen in FIG. 9.

As seen in FIG. 17, magazine floor plate 260 mounts onto magazine tube 120, whereby openings 284 and slots 294 receive tabs 123 of magazine tube 120. The debris falls by gravity through first and second slots 294 and is accumulated within at least one channel 290 and exits via aft section 280, seen in FIG. 12, and/or forward face 270.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

The invention claimed is:

1. An ergonomic magazine self cleaning base plate comprising an exterior face having a perimeter edge, extending from said perimeter edge is a forward face and an aft section, and further comprising an interior face defining at least one channel that extends from said forward face to said aft section, said forward face is open and being defined by said at least one channel and first and second side faces, and said exterior face comprises a hole that extends to said interior face, said at least one channel is open at each of its ends, by gravity debris is accumulated within said at least one channel, and said debris is able to exit via said at least one channel at said aft section and said forward face.

2. The ergonomic magazine self cleaning base plate set forth in claim 1, further characterized in that said exterior face comprises at least one indent.

3. The ergonomic magazine self cleaning base plate set forth in claim 1, further characterized in that said exterior face is convexly shaped.

4. The ergonomic magazine self cleaning base plate set forth in claim 1, further characterized in that said forward face is positioned opposite of said aft section.

5. The ergonomic magazine self cleaning base plate set forth in claim 1, further characterized in that said first and second side faces comprise first and second grip sections.

6. The ergonomic magazine self cleaning base plate set forth in claim 5, further characterized in that said first and second side faces comprise respective first and second sidewalls that are parallel to each other.

7. The ergonomic magazine self cleaning base plate set forth in claim 6, further characterized in that said first and second sidewalls extend a predetermined distance without reaching said aft section.

8. The ergonomic magazine self cleaning base plate set forth in claim 5, further characterized in that said first and second grip sections extend from said perimeter edge, and are relatively concavely shaped.

9. The ergonomic magazine self cleaning base plate set forth in claim 6, further characterized in that said first and second sidewalls extend from respective said first and second grip sections at said interior face.

10. The ergonomic magazine self cleaning base plate set forth in claim 6, further characterized in that said first and second sidewalls comprises respective edges defining respective lips.

11. The ergonomic magazine self cleaning base plate set forth in claim 10, further characterized in that said lips extend a predetermined distance from respective said edge defining side channels respectively.

12. The ergonomic magazine self cleaning base plate set forth in claim 11, further characterized in that said side channels receive a base edge of a magazine tube.

13. The ergonomic magazine self cleaning base plate set forth in claim 12, further characterized in that when said side channels receive said base edge of said magazine tube, said base edge is exposed at a magazine forward face section.

14. The ergonomic magazine self cleaning base plate set forth in claim 13, further characterized in that when said side channels receive said base edge of said magazine tube, said at least one channel and said base edge define at least one opening at said forward face and at said aft section respectively, whereby said forward face and said aft section remain open and connected by said first and second channels.

15. An ergonomic magazine self cleaning base plate comprising an exterior face having a perimeter edge, extending from said perimeter edge is a forward face and an aft section, and further comprising an interior wall, and an interior face having at least one channel that extends from said forward face to said aft section, said at least one channel is open at each of its ends, and is L-shaped, by gravity debris that is accumulated within said at least one channel and exits via said aft section and said forward face.

16. The ergonomic magazine self cleaning base plate set forth in claim 15, further characterized in that said interior wall extends from said aft section toward said forward face defining first and second slots with respective lateral interior faces.

17. The ergonomic magazine self cleaning base plate set forth in claim 15, further characterized in that said forward face is positioned opposite of said aft section, said forward face is defined by said at least one channel, first and second side faces, and said interior wall, and said aft section extends from said perimeter edge to an edge.

18. The ergonomic magazine self cleaning base plate set forth in claim 15, further characterized in that said exterior face comprises a hole that extends to said interior wall, and at least one indent, said exterior face is convexly shaped.

19. The ergonomic magazine self cleaning base plate set forth in claim 17, further characterized in that said first and second side faces comprise first and second grip sections and first and second sidewalls respectively, said first and second grip sections extend from said perimeter edge and are relatively concavely shaped, and said first and second sidewalls extend, parallel to each other, from respective said first and second grip sections.

20. The ergonomic magazine self cleaning base plate set forth in claim 16, further characterized in that first and second lips extends from respective said lateral interior faces defining predetermined openings with said interior wall, whereby said openings and said first and second slots receive respective tabs of a magazine tube.

21. The ergonomic magazine self cleaning base plate set forth in claim 20, further characterized in that when said openings and said first and second slots receive said tabs of said magazine tube said debris falls through said first and second slots and is accumulated within said at least one channel and exits via said aft section and said forward face.

22. The ergonomic magazine self cleaning base plate set forth in claim 16, further characterized in that a magazine insert is positioned onto said interior wall, said magazine insert comprises inner sides that allows said debris that is accumulated onto an exposed section of said interior wall to fall through said first and second slots.

* * * * *